US005083058A

United States Patent [19]

Nonomura et al.

[11] Patent Number: 5,083,058

[45] Date of Patent: Jan. 21, 1992

[54] FLAT PANEL DISPLAY DEVICE

[75] Inventors: Kinzo Nonomura, Ikoma; Satoshi Kitao, Kyoto; Ryuichi Murai, Katano; Jumpei Hashiguchi, Neyagawa; Kiyoshi Hamada, Sakai; Masayuki Takahashi, Katano, all of Japan

[73] Assignee: Matsushita Electric Industrial Co., Ltd., Osaka, Japan

[21] Appl. No.: 539,742

[22] Filed: Jun. 18, 1990

[30] Foreign Application Priority Data

Jun. 19, 1989 [JP] Japan ..... 1-156536
Jul. 17, 1989 [JP] Japan ..... 1-184094

[51] Int. Cl.[5] ..... H01J 31/00

[52] U.S. Cl. ..... 313/482; 313/422; 313/497

[58] Field of Search ..... 313/482, 422, 495, 496, 313/497, 582, 584

[56] References Cited

U.S. PATENT DOCUMENTS

| | | | |
|---|---|---|---|
| 3,914,634 | 10/1975 | Overall et al. | 313/105 |
| 3,935,500 | 1/1976 | Oess et al. | 313/495 |
| 4,034,255 | 7/1977 | Catanese et al. | 313/400 |
| 4,145,633 | 3/1979 | Peters et al. | 313/422 |
| 4,213,072 | 7/1980 | Veith et al. | 313/217 |
| 4,341,980 | 7/1982 | Noguchi et al. | 315/169 I |
| 4,356,427 | 10/1982 | Noguchi et al. | 313/422 |
| 4,622,492 | 11/1986 | Barten | 313/422 |
| 4,900,981 | 2/1990 | Yamazaki et al. | 313/422 |

FOREIGN PATENT DOCUMENTS

| | | |
|---|---|---|
| 0002000B1 | 5/1979 | European Pat. Off. . |
| 0228052A1 | 12/1986 | European Pat. Off. . |
| 56-28445 | 3/1981 | Japan . |
| 56-38750 | 4/1981 | Japan . |
| 56-38751 | 4/1981 | Japan . |
| 57-5254 | 1/1982 | Japan . |

OTHER PUBLICATIONS

"A Flat-Panel TV Display System in Monochrome and Color", IEEE Transactions on Electron Devices, vol., ED-22, No. 1, Jan. 1975, pp. 1-7.

Patents Abstracts of Japan, Aug. 19, 1981, vol. 5, No. 129 (E-70) (801).

*Primary Examiner*—Michael Razavi
*Assistant Examiner*—Steven P. Klocinski
*Attorney, Agent, or Firm*—Wenderoth, Lind & Ponack

[57] ABSTRACT

A flat panel display device includes a face plate made of a transparent material, a back plate positioned parallel to the face plate, and a wall member extending between the face plate and back plate to define an airtight housing. An anode is provided on a inner surface of the face plate, a fluorescent layer is provided in association with the anode, and a cathode is provided in association with an inner surface of the back plate. A plurality of struts, made of an electrically conductive screen printed powdery material, are tightly held between the back plate and the face plate, such that an electric charge accumulated between the anode and cathode is discharged by a leakage current flowing through the struts.

15 Claims, 7 Drawing Sheets

FLAT PANEL DISPLAY DEVICE

BACKGROUND OF THE INVENTION

1. Field of the Invention

The present invention generally relates to a flat panel display device having electrodes and a luminous layer. This invention may be embodied, for example, in a television set or a calculator, but it will be appreciated that it is also useful in other applications.

2. Description of the Prior Art

Many of the patents issued in various countries recognize the need for employing a support inside the evacuated flat panel display device in order to make the display device withstand the atmospheric pressure.

For example, U.S. Pat. No. 4145633 which was issued to Peters et al. on Mar. 20, 1979 is typical of such systems, as are U.S. Pat No. 4341980 which was issued to Noguchi et al. on July 22, 1982; U.S. Pat. No. 4356427 which was issued to Noguchi et al. on Oct. 26, 1982; U.S. Pat. No. 4622492 which was issued to Barton on Nov. 11, 1986; and U.S. Pat. No. 4900981 which was issued to Yamazaki et al. on Feb. 13, 1990 (corresponding to the Japanese Laid-open Patent Publication No. 62-147635, published July 1, 1987)

FIGS. 1A and 1B show the support which U.S. Pat. No. 4145633 discloses. In this patent, a plurality of spaced, parallel, substantially semi-cylindrical beads 132 of a rigid material are disposed on one surface of face plate 131 and are surrounded by the phosphor plate. Each of beads 132 fits in the groove 134 defined in a metal strut 133 to avoid a lateral movement of the electrode. One end of each metal strut 133 opposite to the groove 134 is directly compressed into the support 136 of insulative material, such as glass, through a respective hole defined in the shadow mask 135. The phosphor plate, the metal strut 133 and the shadow mask 135 are applied the same voltage. However, since this panel has a construction wherein a contact to the control electrodes having a lower voltage than that of shadow mask 135 is made through the insulating support 136, the application a required high voltage to this panel is not permitted due to the tendency of a spark discharge to occur through the support 136.

Furthermore, because this support 136 is connected to the phosphor plate through the metal strut 133, unless an electrode having a substantially same voltage between shadow mask and phosphor plate exists, the electron beam may be deflected out of its intended trajectory under the influence of the voltage of the support.

FIG. 2 shows the support which U.S. Pat. Nos. 4341980 and 4356427 disclose. Between the metal back layer 143, disposed on fluorescent layer 144, and the third electrode 141, from among a plurality of flat electrodes, a cylindrical insulator 142 as a support is arranged. U.S. Pat. Nos. 4341980 and 4356427 specifically disclose the property required for support 142. If this support 142 is made of a well-known glass material, the support 142 will lose an insulating property because the dielectric property is lowered with time. Therefore, this patent suggests the use of non-alkaline glass as the material for the support. However, the use of glass of such a special composition is disadvantageously costly. In addition, the necessity of the support being processed to assume a rod-like configuration with the use of glass of the special composition renders and in cost. Furthermore, it is inevitable for the rod-like support to be thinner as the pitch between each neighboring pixels on fluorescent layers is reduced. This in turn narrows the electrode-to-electrode distance, resulting in the a reduction in breakdown voltage characteristic.

FIGS. 3A and 3B show the struts disclosed in U.S. Pat. No. 4622492. The envelope of the flat panel display device is divided into a number of modules by means of reinforcement partitions 151. These partitions 151 made of electric insulator have a portion of deflection electrodes 152 and contact the display screen 153. This invention is featured in the envelope having a V-shaped concave groove on its outer surface to make the partitions 151 substantially invisible. However, the display panel of this patent cannot be applied a required high potential for the same reason as that discussed in connection with U.S. Pat. No. 4145633.

U.S. Pat. No. 4622492 also discloses an embodiment of a gas discharge panel. However, this gas discharge panel has a problem in that a discharging ability cannot be maintained stably due to its construction having the reinforcement partitions made of an electric insulator.

FIG. 4 shows the support disclosed in U.S. Pat. No. 4900981. This support 161 comprises a supporting plate 162 and a supporting rod 163 which faces a fluorescent layer 165 on a face plate 164. Because supporting rod 163 made of metal is applied the same potential as a high voltage applied to a fluorescent layer 165, there will be no spark discharge available. However, a spark discharge takes place so often around deflecting electrodes formed on supporting plate 162 made of electric insulator. Particulary, as between electrodes to which is applied a substantially same voltage as that applied to fluorescent layer 165 and adjacent electrodes, spark discharge occurs readily.

Large-sized flat panel display devices of the prior art employ supports arranged inside the panel to hold and prevent the panel from undergoing an implosion by the effect of atmospheric pressure.

However, these supports made of an insulator make it difficult to maintain a sufficient voltage breakdown characteristic since those supports are positioned between an electrode such as a fluorescent layer, applied with a high voltage, and an electrode such as a electrode facing the fluorescent layer to which a voltage lower than that high voltage is applied. It is too difficult to realize a insulator providing a sufficient distance between each electrodes and no visual damage by its own shadow to the display screen.

SUMMARY OF THE INVENTION

The present invention has been developed with a view to substantially eliminating the above discussed problem inherent in the prior art flat panel display devices and is intended to provide an improved flat panel device wherein means is provided to avoid possible damage of not only the luminous layer and electrodes but also of the entire device which would otherwise be damaged by a spark discharge between members having a high electric potential difference.

In order to accomplish this object, the present invention provides a flat panel display device which comprises a luminous layer, electrodes, conductive support struts and a casing body.

According to the present invention, the conductive support struts located on at least one of two opposite surfaces of plate members are designed to substantially eliminate electric spark discharge. Preferably, each conductive support strut is made of a glass material so as to define a generally conical dot shape or bead-like shape.

BRIEF DESCRIPTION OF THE DRAWINGS

This and other objects and features of the present invention will readily be understood from the following description taken in conjunction with preferred embodiments thereof with reference to the accompanying drawings, in which.

DETAILED DESCRIPTION OF THE EMBODIMENT

First Embodiment

Figure 1A:
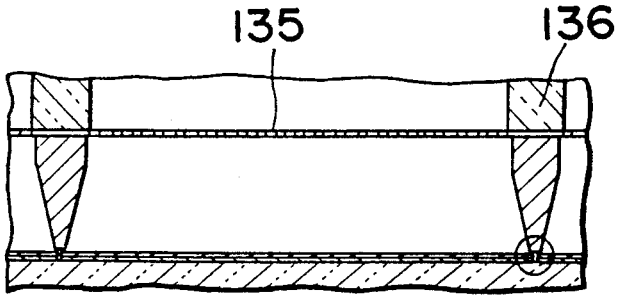
Fig. 1A PRIOR ART
FIG. 1A shows a fragmentary sectional view of a portion of one of the prior art panels.
Figure 1B:
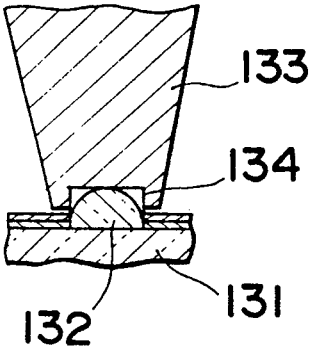
Fig. 1B PRIOR ART
FIG. 1B shows a fragmentary sectional view showing, on an enlarged scale, a portion of FIG. 1A which is enclosed by the circle.
Figure 2:
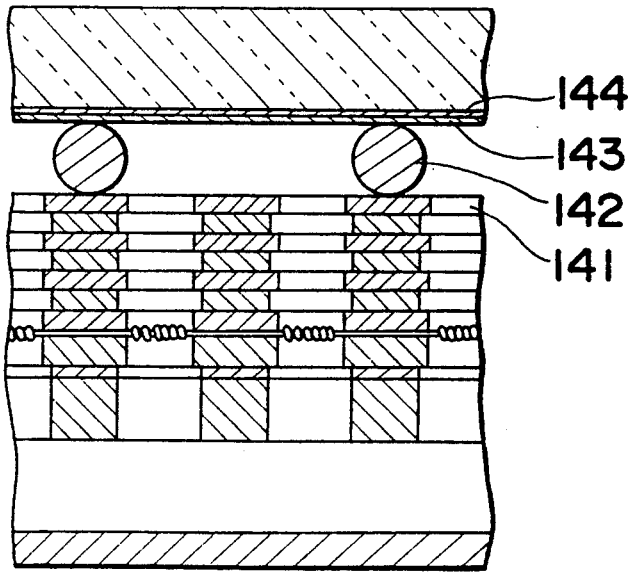
Fig. 2 PRIOR ART
FIG. 2 shows a fragmentary sectional view of a portion of another one of the prior art panels.
Figure 3A:
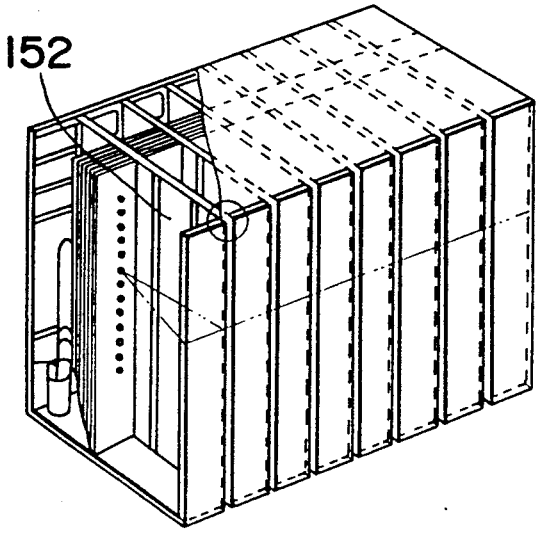
Fig.3A PRIOR ART
FIG. 3A shows a perspective view, which a portion removed, of still another one of the prior art panels.
Figure 3B:
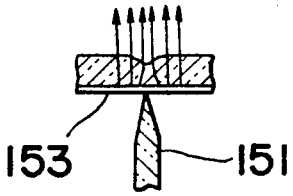
Fig.3B PRIOR ART
FIG. 3B shows a fragmentary sectional view of a portion of FIG. 3A which is enclosed by the circle.
Figure 4:
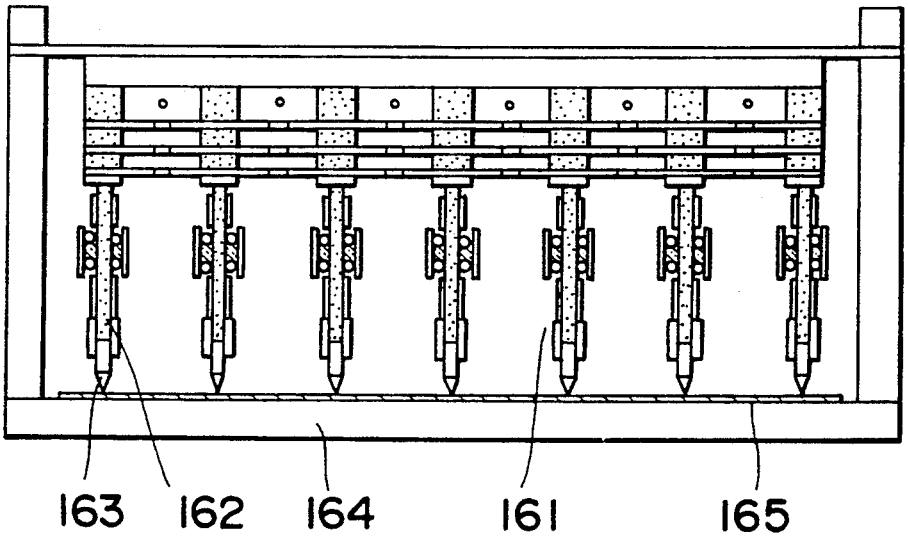
Fig.4 PRIOR ART
FIG. 4 shows a sectional view of a portion of a further one of the prior art panels.
Figure 5:
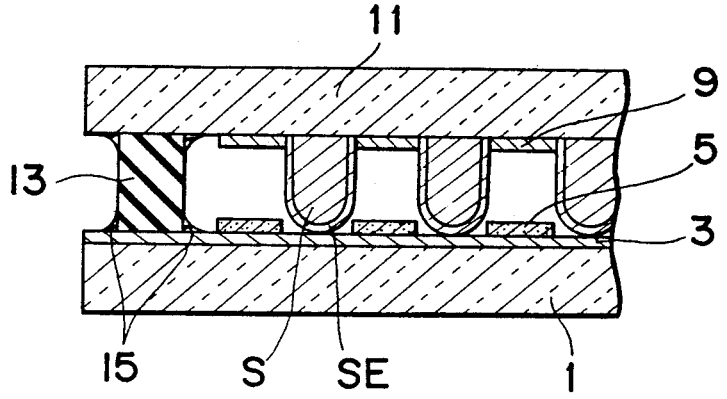
FIG. 5 shows a fragmentary sectional view of a flat panel display device according to a first embodiment of the present invention.

Referring to FIG. 5, a flat panel display device according to a first embodiment of the present invention is shown which comprises a face plate 1 made of a transparent material, such as glass, an anode 3 deposited on the face plate 1, and a fluorescent member 5 deposited on the anode 3. The fluorescent member 5 may be provided over the entire anode 3 or in a striped pattern. The flat panel display device further has a back plate 11 also made of glass and side walls 13 extending between the face plate 1 and back plate 11 and along the perimeter of the face and back plates so as to define an airtight housing using a sealing member 15 applied at joints between the face plate 1 and side wall 13, and also between the back plate 11 and side wall 13.

Deposited on the back plate 11 are a cathode 9 and a plurality of struts S. Cathode 9 is formed by a metal embossed plate made of for example, tangsten, molybdenum, and is used as a field emitter. According to the preferred embodiment, struts S are formed by screen printing effected on the back plate 11. Thus, the tip of each strut S is rounded as shown in FIG. 5. Each strut may be so formed as to have a shape of round projection as in the shape of thimble or to have a shape of an elongated oval projection as in the shape of semi-cylindrical beads. According to a preferred embodiment, outer the surface of each strut may be covered with a material SE for enhancing the secondary emission of electrons, resulting in multiplication of the electron beams, thus realizing a brighter image on the display. The secondary emission material SE can be formed by glass through screen printing, resulting . in simple manufacturing steps and low manufacturing cost. The height of each strut S is approximately equal to the height of side wall 13. Inside the housing defined by face and back plates 1 and 11 and side wall 13 exists a vacuum, so that by the atmospheric pressure, face and back plates 1 and 11 are forced towards each other, resulting in pressure contact of struts S against the anode 3.

In operation, when a power is turned on, each cathode 9 emits electrons toward the facing anode 3 in response to the voltage applied thereto. When emitted electrons impinge on anode 3, fluorescent member 5 emits light so as to provide an illuminating image on face plate 1, when viewed from in front of the face plate.

Struts S are made of electric conductive material, such as glass but containing PbO as the major elements, by the technique of screen printing. According to the present invention, each strut S, particularly the surface layer thereof, has such an electric conductive characteristics that the specific resistance is set between $10^6$ to $10^{10}$ Ω.cm. Other materials such as Pd compounds, Ag compounds, $RuO_2$ compounds or Pt compounds can be used for forming the struts. For $RuO_2$ compound, $Pb_2Ru_2O_6$ or $Bi_2Ru_2O_7$ can be used. As the electric potential between anode 3 and cathode 9 increases, a small leakage current, such as 1 μA in total through all the struts, flows through the struts. Thus, the electric potential accumulated between electrodes 3 and 9 will be maintained within a predetermined level, so that no spark discharge will take place between the electrodes 3 and 9.

Second Embodiment

Figure 6:
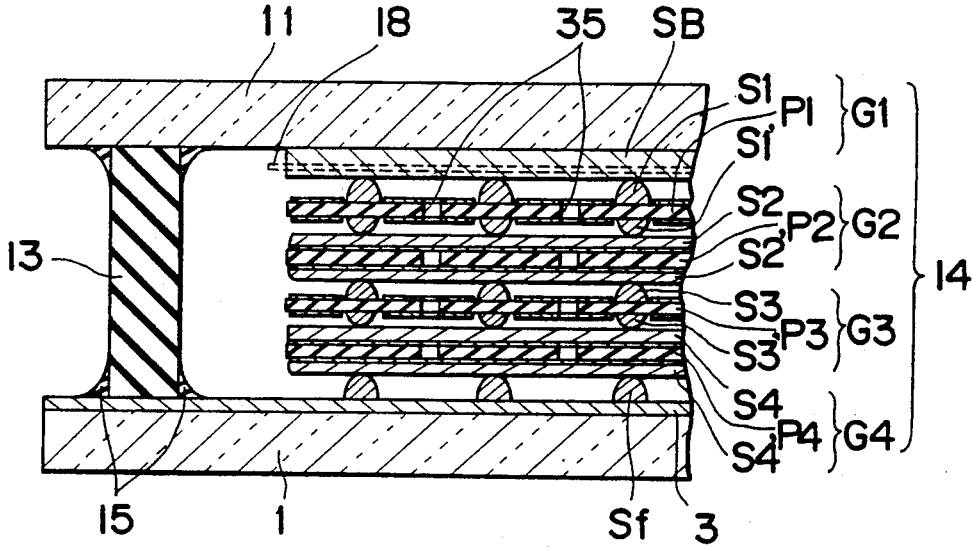
FIG. 6 shows a fragmentary sectional view of the flat panel display device according to a second embodiment of the present invention.

Referring to FIG. 6, a flat panel display device according to a second embodiment comprises face plate 1 on which a anode 3 and fluorescent member (not shown) are deposited, a back plate 11 on which a filament cathode structure 18 is supported by a suitable spring and a side wall 13 connected to face plate 1 and back plate 11 in an airtight manner. An airtight housing is defined by back plate 11 carrying filament cathode 18 as the electron beam source, face plate 1 and side wall 13. According to the second embodiment shown in FIG. 6, face plate 1 further has struts Sf and back plate 11 further has struts SB, which are rigidly mounted respective plates in a similar manner described above in connection with FIG. 5.

The struts Sf on face plate 1 extend parallel to each other with a predetermined pitch provided therebetween. Likewise the struts SB on back plate 11 extend parallel to each other with a predetermined pitch provided therebetween. Furthermore the struts Sf on face plate 1 and the struts SB on back plate 11 are in orthogonal relationship to each other.

Provided in the housing, particularly between face plate 1 and back plate 11 is an intermediate electrode structure 14, which according to the second embodiment comprises four beam control layers G1, G2, G3 and G4, which are placed one over the other.

Figure 7:
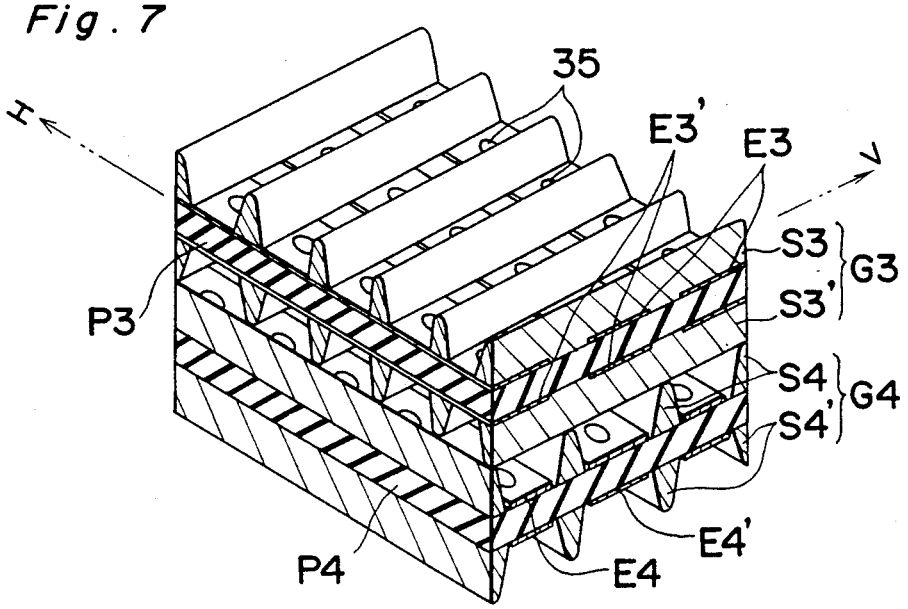
FIG. 7 shows a fragmentary view, on an enlarged scale, of the flat panel display device of FIG. 6.

Referring to FIG. 7, beam control layer G3 comprises an insulation plate P3 having an upper surface deposited with elongated electrodes E3 and a lower surface deposited with elongated electrodes E3', such that electrodes E3 and E3' extend in parallel to and opposing relationship with each other. In this embodiment, it is assumed that the direction in which the elongated electrodes E3 and E3' extend corresponds to a horizontal scan direction, as shown by an arrow H, and the direction perpendicular to the H direction is a vertical scan direction, as shown by an arrow V.

A plurality of through holes 35 are provided, each extending from electrode E3 through P3 to opposite electrode E3'. Through-holes 35 are aligned along each electrode at a predetermined pitch. Thus, through holes 35 are aligned in two orthogonal directions, i.e. the horizontal direction and the vertical direction. Furthermore, beam control layer G3 has struts S3 mounted on the upper surface of the insulation plate P3 crossing electrodes E3 and extending in the vertical direction at a predetermined pitch, but orthogonal to the electrodes E3, which extend in the horizontal direction. Struts S3 are positioned between a line along which holes are vertically aligned and another line along which adjacent holes are vertically aligned, so that struts S3 do not cover any of the through holes 35.

Similarly, beam control layer G3 has struts S3' mounted on the lower surface of the insulation plate P3 electrodes E3' and extending in the vertical direction at a predetermined pitch. Since struts S3' are positioned in opposing relationship with struts S3' the through-holes are not be covered by the struts S3'. Thus, both struts S3 and S3' extend in the vertical direction for in the beam control layer G3.

Other beam control layers G1, G2 and G4 are formed in a similar manner to beam control layer G3.

The beam control layer G4 is placed on the face plate 1 such that the struts Sf mounted on face plate 1 are disposed perpendicularly with respect to the struts S4, provided in the beam control layer G4 with rounded tips thereof being held in contact with each other.

Similarly, the beam control layer G3 is placed on the beam control layer G4 such that the struts S4 of layer G4 are disposed perpendicularly to the struts S3' provided in the beam control layer G3 with rounded tips thereof being held in contact with each other.

Likewise the beam control layer G2 is placed on the beam control layer G3 such that the struts S3 of layer G3 are disposed perpendicularly to the struts S2' provided in the beam control layer G2 with rounded tips thereof being held in contact with each other. Furthermore, the beam control layer G1 is placed on the beam control layer G2 such that the struts S2 of layer G2 are disposed perpendicularly to the struts S1' provided in the beam control layer G1 with rounded tips thereof being held in contact with each other.

Finally, beam control layer G1 is placed immediately under the back plate 11 such that the struts SB mounted on back plate 11 are disposed perpendicularly with respect to the struts S1' provided in the beam control layer G1 with rounded tips thereof being held in contact with each other. Inside the housing defined by face and back plates 1 and 11 and side wall 13 exists a, so that by the atmospheric pressure, face and back plates 1 and 11 are forced towards each other, resulting in pressure contact of struts, such as between SB and S1, S1' and S2, S2' and S3, and so on.

Figure 8:
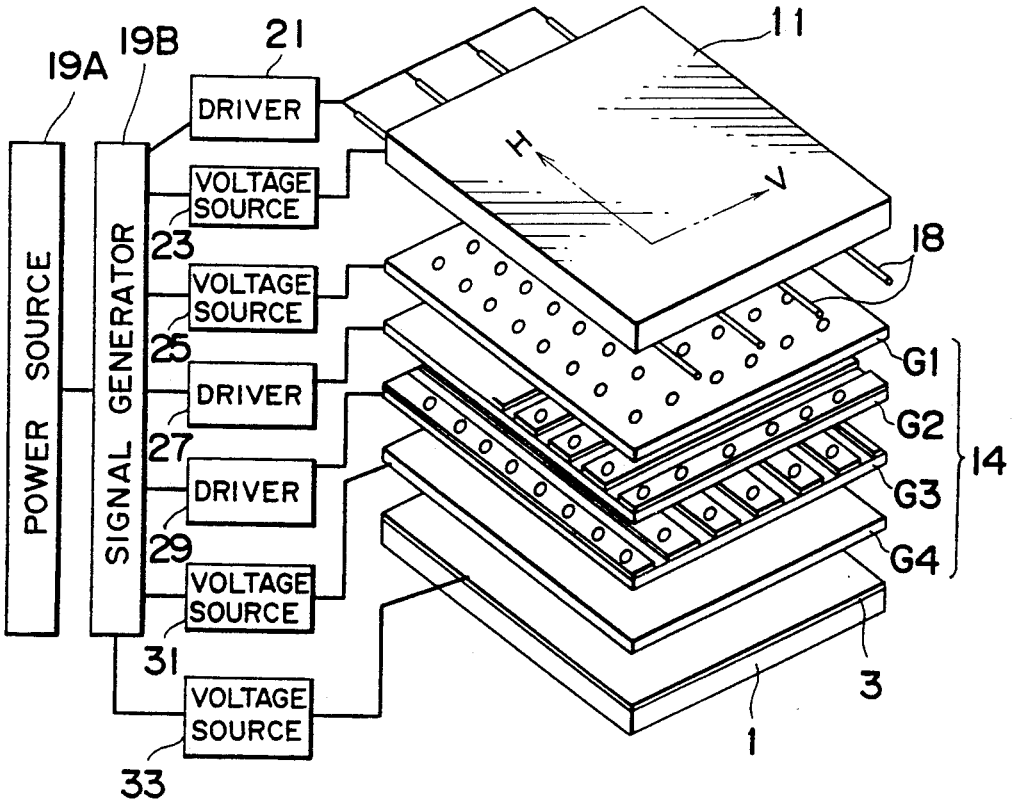
FIG. 8 shows an exploded view of the flat panel display device of FIG. 6 with power circuits.

As shown in FIG. 8, a cathode driver 21 is connected to cathode 18; back plate voltage source 23 is connected to a back plate electrode provided on the back plate 11; G1 voltage source 25 is connected to electrodes provided in beam control layer G1; G2 driver 27 is connected to electrodes provided in beam control layer G2; G3 driver 29 is connected to electrodes provided in beam control layer G3; G4 voltage source 31 is connected to electrodes provided in beam control layer G4; and anode voltage source 33 is connected to anode 3 provided on the face plate 1. Furthermore, all the circuits 21, 23, 25, 27, 29, 31 and 33 are connected to a signal generator 19B which is in turn connected to a power source 19A.

In operation, when a power is turned on, each filament cathode 18 emits a plurality of electron beams diversely in response to the voltage applied between the back plate electrode and intermediate electrode G1. The electrons are transmitted through through-holes 35. The electron beams are controlled by modulation electrode G2, having a plurality of strip electrodes extending in vertical direction V to which a displaying signal for each pixel is applied.

Furthermore, electron beams are controlled by layer G3 in association with driver 29 such that one electrode of a plurality of electrodes in layer G3 extending in horizontal direction H is applied with a voltage from driver 29 so as to permit an electron beam to pass through the through-holes 35 provided along said one electrode and also to prevent the electron beam from passing through other through-holes 35 provided along electrodes other than said one electrode.

Thereafter, electron beams are further controlled by layer G4 such that the electron beams are converged and focused on a suitable spot having a predetermined diameter within the fluorescent member to produce an image on the face plate 1.

Other than the layers G1 to G4 described above, it is possible to provide a further control layer to suitably deflect the electron beams.

Since struts SB, S1, S1', S2, S2', S3, S3', S4, S4, and SB are made of electric conductive material in the same manner as that described above in connection with FIG. 5, a small leakage current flows through the struts. Thus, the electric potential accumulated between the facing electrodes, such as anode 3 and electrode E4' will be maintained within a predetermined level, so that no spark discharge will take place between the electrodes 3 and E4', or between any other facing electrodes.

In the case when the facing electrodes have a relatively low electric potential therebetween, i.e., where there is less possibility of producing the spark discharge, it is possible to exchange some of the electrically conductive struts with electrically non-conducive spacers to be used between such electrodes.

Furthermore, in the second embodiment, it is so described that the struts are provided on both surfaces of each of beam control layer so as to obtain a sufficient distance between the layers, but can be so arranged that the struts may be provided on only one surface of any of the beam control layer if a sufficient distance can be obtained by the use of struts on only one surface.

Third Embodiment

Figure 9:
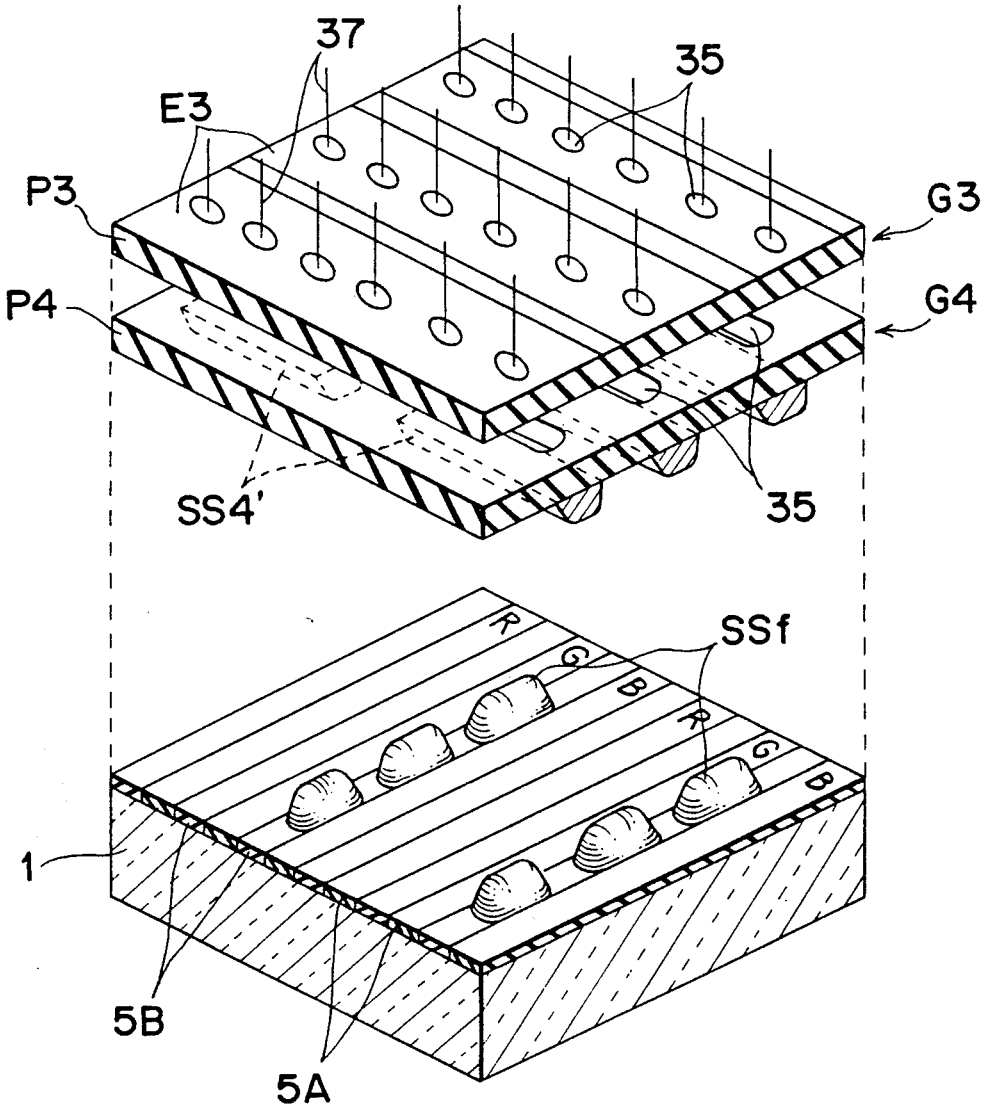
FIG. 9 shows a fragmentary view of a further modified flat panel display device according to a third embodiment of the present invention.

Referring to FIG. 9, a flat panel display device according to a third embodiment is shown in which only the face plate 1 and two beam control layers G3 and G4 are shown, but the back plate and other beam control layers are omitted for the sake of brevity.

In this embodiment, the flat panel display device is in particularly for a color display device so that face plate 1 has the fluorescent member defined by black and color stripes 5B and 5A occurring alternatively, and the color stripes being varied, for example, in the order of red, green and blue. Furthermore, an aluminum sheet is placed so as to cover both black and color stripes 5B and 5A. The black stripes 5B can be made by the use of graphite. Instead of elongated struts Sf, a plurality of separated struts SSf are aligned in the vertical direction along and over the black strips so that color stripes 5A will not be hindered by any of the struts. Furthermore, the elongated struts S4' provided in beam control layer G4 are also replaced with separated struts SS4'.

Each strut is made from powder glass mainly containing PbO under the process of a screen printing method. According to the preferred embodiment, the separated strut has such a dimension that its width, length and height are about 100 μm, 300 μm, and 100 μm, respectively. In this case, the strut width is made approximately equal to the width of the black strip 5B.

In order to form the separated strut having a size explained above, five to ten times of repetitive operation of screen printing is required. After each screen printing operation, drying process is performed. Thereafter, at the final stage of the screen printing, the deposited struts are sintered at about 450° C. and then are further sintered at about 300–550° C. under hydrogen atmosphere. The obtained struts will have such an electric conductive characteristics that the specific resistance of the strut is between $10^6$ to $10^{10}$ Ω.cm.

The conductive surface layer of the strut is also effective as a secondary electron emitter. Some other compound such as Pd-Ag compound, $RuO_2$ compound or Pt compound are also applicable for making the struts having conductive surface under screen printing.

Additionally, deposition of secondary electron emitting material such as MgO on the surface of the sintered strut can be applied, resulting in such an advantage that the electron beam current increases to eventually increase the brightness of the image on the screen.

According to the embodiment shown in FIG. 9, only the struts SSf on face plate 1 and the struts SS4' on lower surface of beam control layer G4 are shown, but it is apparent to those skilled in the art that the similar struts are mounted on other surfaces.

It is possible to make each struts smaller in length so that each struts has a shape similar to a thimble. Furthermore, a plurality of thimble shaped struts may be aligned vertically and horizontally, or alternately, they may be provided at random.

In operation, electron beams 37 are guided through apertures 35 of layers G3 and G4 and impinge on fluorescent element 5A. The voltage applied to each electrode in layer G3 is approximately less than 500 V, to each electrode in layer G4 is approximately 1 to 2 KV, and to each thin film of aluminum layer is approximately 3 to 5 KV.

It is possible to form struts S so as to have a keen top through screen printing and sintering process. Struts S with such a keen top aligned in horizontal and vertical directions will provide a spot contact, resulting in less flow of electric current, thus minimizing the power consumption of the flat panel display device.

It will be apparent to those skilled in the art that the present invention achieves a flat panel display device which can withstand the high potential between electrodes without a spark discharge.

Once a spark discharge takes place between the fluorescent layer and the beam control layer, the graphite thin film defining the black line 5B or fluorescent element 5A will diffuse, resulting in unrecoverable damaged of the flat panel display device.

According to the present invention, since the fluorescent layer and the beam control layer make a spot contact when placed one over the other, the current through the strut reduces the possibility of producing the spark discharge. Furthermore, since the current flowing through the struts is relatively low, the energy consumption of the flat panel display device can be minimized.

Furthermore, since struts formed on the fluorescent layer are held in contact with struts formed on the beam control layer G4, the struts on the beam control layer G4 will not be held directly in contact with the fluorescent layer. Thus, the quality of the display will not be reduced.

As struts are formed on the non-luminous part of the fluorescent layer, all the displaying pixels originally formed on the fluorescent layer are ensured for operation.

Figure 10:
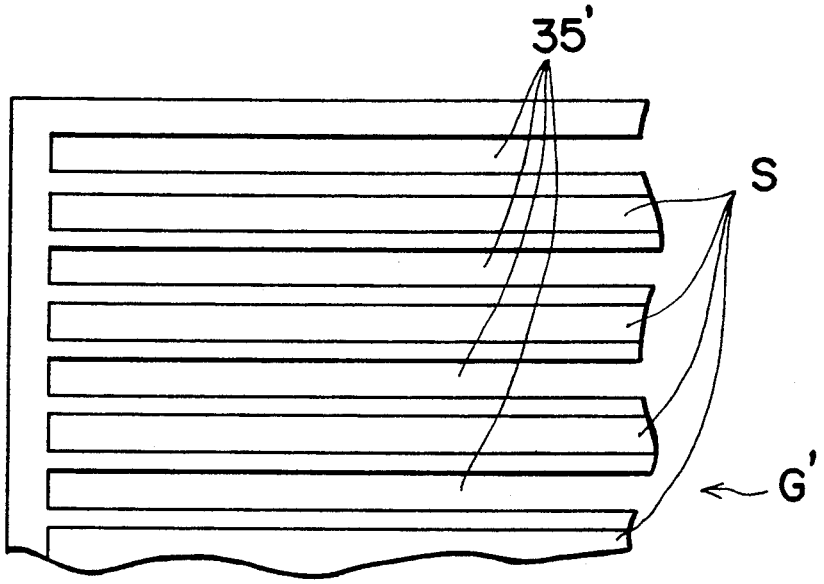
FIG. 10 shows a perspective view showing modified intermediate electrodes which may be employed in any one of the second and third embodiments of the present invention.

Referring to FIG. 10, a modified beam control layer G' is shown. According to this modification, the beam control layer G' has, instead of through-holes 35, a plurality of slits 35' extending parallel to each other. Struts S are provided on the beam control layer portions between the slits. With this modification, the positioning of the beam control layer G' can be done with more freedom, particularly in the slit extending direction. Thus, this construction reduces a precision requirement for locating the beam control layers.

Figure 11:
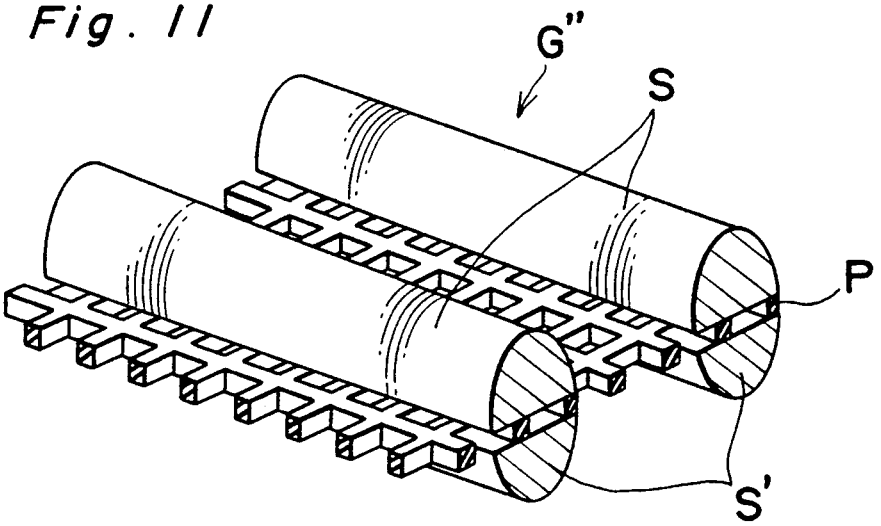
FIG. 11 shows a plane view of the modified intermediate electrodes of FIG. 10.

Referring to FIG. 11, another modified beam control layer G'' is shown. The beam control layer G'' is formed by a meshed plate, so as to reduce the precision of positioning required for the beam control layer G''. If a mesh having sufficiently fine holes, when compared with the interval of struts is employed, the precision requirement for positioning the beam control layer G'' can be reduced.

Furthermore, the meshed beam control layer G'' can absorb the difference, caused by the thermal expansion, between the beam control layer G'' and struts S, diminishing adverse influences on the quality of display.

Fourth Embodiment

Figure 12:
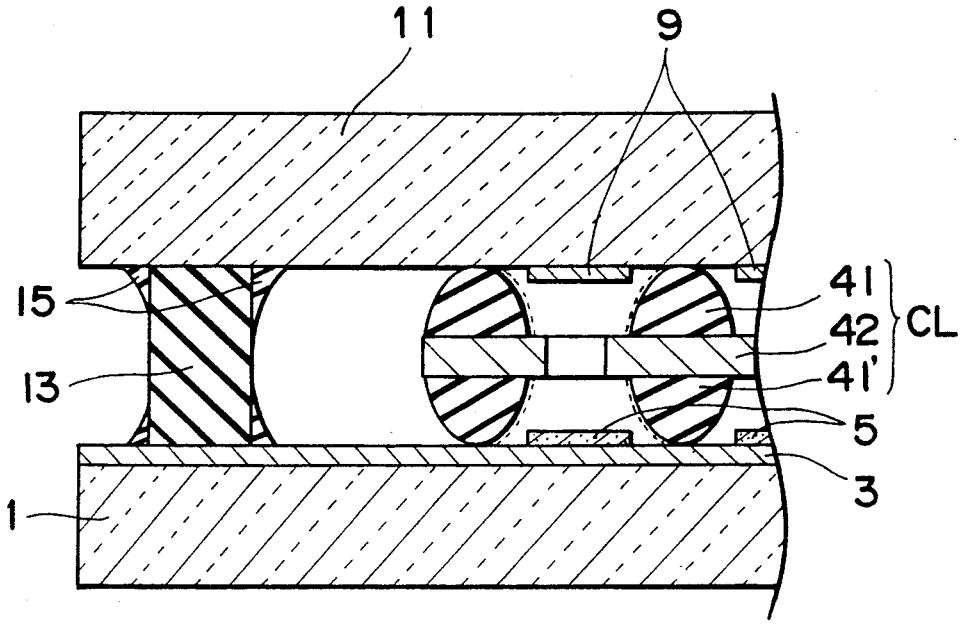
FIG. 12 shows a fragmentary sectional view of a fourth embodiment of the flat panel display device of the present invention.

Referring to FIG. 12, a flat panel display device according to a fourth embodiment is shown which comprises a face plate 1 made of a transparent material, such as glass, an anode 3 deposited on the face plate 1, and a fluorescent member 5 deposited on the anode 3. The fluorescent member 5 may be provided over the entire anode 3 or in a striped pattern. The flat panel display device further has a back plate 11 also made of glass and side walls 13 extending between the face plate 1 and back plate 11 and along the perimeter of the face and back plates so as to define an airtight housing using a sealing member 15 applied at joints between the face plate 1 and side wall 13, and also between the back plate 11 and side wall 13.

Cathode 9 is formed by an metal embossed plate made of for example, tangsten, molybdenum, and is used as a field emitter.

Provided in the housing, particularly between face plate 1 and back plate 11 is an intermediate spacing structure CL, which comprises an conductive plate 42 having an upper surface deposited with a semi-cylindrical bead 41 and a lower surface deposited with a semi-cylindrical bead 41', such that semi-cylindrical beads 41 and 41' extend in parallel to and in opposing relationship with each other. Conductive plate 42 is formed with through-holes for permitting the electron beam to pass therethrough. The height of intermediate spacing structure CL having semi-cylindrical beads deposited on both surfaces is approximately equal to the height of side wall 13. Inside the housing defined by face and back plates 1 and 11 and side wall 13 exists a, so that by the atmospheric pressure, face and back plates 1 and 11 are forced towards each other, resulting in pressure contact of semi-cylindrical beads 41 and 41' against the cathode 9 and the anode 3 respectively.

In operation, when a power is turned on, each cathode 9 emits electrons toward the facing anode 3 in response to the voltage applied thereto. When emitted electrons impinge on anode 3, fluorescent member 5 emits light so as to provide an illuminating image on face plate 1, when viewed from in front of the face plate.

Semi-cylindrical beads 41 and 41' are made of electrical insulator by the technique of screen printing.

Semi-cylindrical beads 41 and 41' are made of insulator and are locate on both sides of conductive plate 42 to provide a long discharge path, DP (shown by a dotted line in FIG. 12), which would be formed on the surface of semi-cylindrical beads 41 and 41'. This distance will prevent the possible spark discharge between electrodes since an increase of this distance by 100 $\mu$m improves approximately 1 KV of a withstand voltage when this distance is equal to or smaller than 2 mm. Even if a spark discharge takes place, conductive plate 39 sandwiched by semi-cylindrical beads 41 and 41' will receive such discharge current. Thus, a flat panel display device is protected from the occurrence of spark discharge between electrodes.

Semi-cylindrical beads 41 and 41' improve the withstand voltage between cathode 9 and anode 3 by providing a long discharge path DP.

Figure 13:
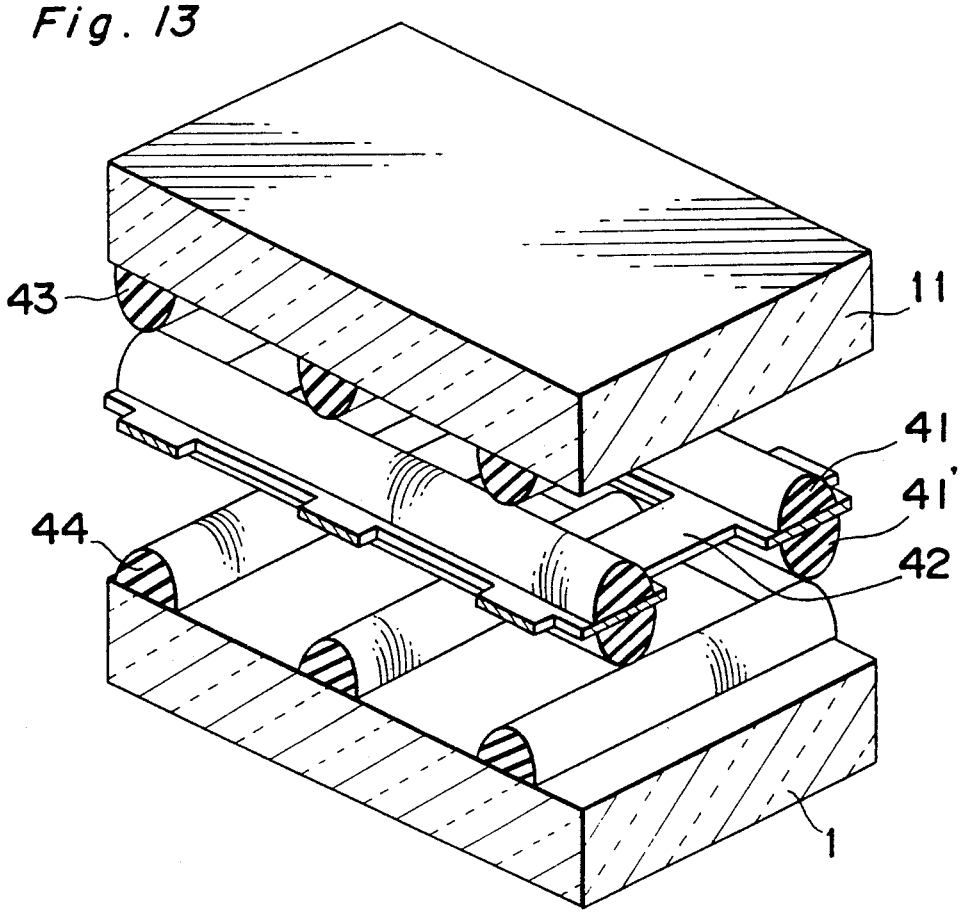
FIG. 13 shows an exploded view, on an enlarged scale, showing a modification of the device of FIG. 12.

Referring to FIG. 13, a modification of the fourth embodiment is shown, which is so arranged as to acquire longer discharge path DP. According to this modification, semi-cylindrical beads 43 and 44 are additionally formed on back plate 11 and face plate 1, respectively. By the arrangement of FIG. 13, improved withstand voltage characteristics can be obtained without changing the size of semi-cylindrical beads or changing its pitch. This can be obtained by inserting a further set of semi-cylindrical beads having a similar construction as that described above between, for example, face plate 1 and intermediate spacing structure CL.

It will be apparent from the foregoing description that the present invention, as described above, achieves stable withstanding voltage characteristics and a clear and high quality image without resulting adverse influences, such as shading, caused by the struts or the semi-cylindrical beads.

What is claimed is:

1. A flat panel display device comprising:

a face plate made of transparent material;

a back plate positioned parallel to said face plate;

a wall member extending between said face plate and back plate around the perimeter thereof to define an airtight housing:

a beam control layer inserted between said face plate and back plate;

an anode provided on an inner surface of said face plate;

a fluorescent layer provided in association with said anode;

a cathode provided in association with an inner surface of said back plate; and a plurality of struts, comprised of electrically conductive screen printed powdery material, tightly held between said beam control layer and face plate;

wherein said struts include first struts provided on said beam control layer extending parallel to each other in a first direction and spaced a predetermined pitch, and second struts provided on said face plate extending parallel to each other in a second direction perpendicular to said first direction and spaced a predetermined pitch, so that said struts are held in contact crossingly with each other at their tips;

whereby an electric charge accumulated between said anode and beam control layer is discharged by a leakage current flowing through said struts.

2. A flat panel display device as claimed in claim 1, wherein said struts are separated.

3. A flat panel display device as claimed in claim 1, further comprising a plurality of struts made of electrically conductive material tightly held between said back plate and beam control layer.

4. A flat panel display device as claimed in claim 3, wherein said struts includes third struts provided on said back plate extending parallel to each other in first direction and spaced a predetermined pitch, and fourth struts provided on said beam control layer extending parallel to each other in second direction, perpendicular to said first direction, and spaced a predetermined pitch, so that struts are held in contact crossingly with each other at their tips.

5. A flat panel display device as claimed in claim 4, wherein said struts are separated.

6. A flat panel display device comprising:

a face plate made of transparent material;

a back plate positioned parallel to said face plate;

a wall member extending between said face plate and back plate around the perimeter thereof to define an airtight housing:

first and second beam control layers placed one over the other and inserted between said ace plate and back plate;

an anode provided on an inner surface of said face plate;

a fluorescent layer provided in association with said anode;

a cathode provided in association with said back plate; and a plurality of struts, comprised of electrically conductive screen printed powdery material, tightly held between said first and second beam control layers;

wherein said struts include first struts provided on said first beam control layer extending parallel to each other in a first direction and spaced a predetermined pitch, and second struts provided on said second beam control layer extending parallel to each other in a second direction perpendicular to said first direction and spaced a predetermined pitch, so that said struts are held in contact crossingly with each other at their tips;

whereby an electric charge accumulated between said first and second beam control layers is discharged by a leakage current flowing through said struts.

7. A flat panel display device as claimed in claim 6, wherein said struts are separated.

8. A flat panel display device comprising:

a face plate made of transparent material;

a back plate positioned parallel to said face plate;

a wall member extending between said face plate and back plate around the perimeter thereof to define an airtight housing:

a conductive plate made of electrically conductive material and inserted between said face pate and back plate;

an anode provided on an inner surface of said face plate;

a fluorescent layer provided in association with said anode;

a cathode provided in association with an inner surface of said back plate;

a plurality of first semi-cylindrical struts made of electrically non-conductive material and mounted on one surface of said conductive plate;

a plurality of second semi-cylindrical struts made of electrically non-conductive material and mounted on another surface of said conductive plate, a plurality of third semi-cylindrical struts made of electrically non-conductive material and mounted on said back plate and extending perpendicular to and held tightly in contact with said first semi-cylindrical struts; and a plurality of fourth semi-cylindrical struts made of electrically non-conductive material and mounted on said face plate and extending perpendicular to and held tightly in contact with said second semi-cylindrical struts;

whereby an electric charge accumulated between said anode and cathode is discharged along an outer surface of said first and second semi-cylindrical beads through said conductive plate.

9. A flat panel display device comprising:

a face plate made of transparent material;

a back plate positioned parallel to said face plate;

a wall member extending between said face plate and back plate around the perimeter thereof to define an airtight housing:

a beam control layer inserted between said face plate and back plate;

an anode provide don an inner surface of said face plate;

a fluorescent layer provided in association with said anode;

a cathode provided in association with an inner surface of said back plate; and a plurality of struts made of electrically conductive material tightly held between said beam control layer and face plate, whereby an electric charge accumulated between said anode and beam control layer is discharged by a leakage current flowing through said struts, wherein said struts include first struts provided on said beam control layer extending parallel to each other in a first direction and spaced a predetermined pitch, and second struts provided on said face plate extending parallel to each other in a second direction, perpendicular to said first direction, and spaced a predetermined pitch so that said struts are held in contact crossingly with each other at their tips.

10. A flat panel display device as claimed in claim 9, wherein said struts are separated.

11. A flat panel display device as claimed in claim 9, further comprising a plurality of struts made of electrically conductive material tightly held between said back plate and beam control layer.

12. A flat panel display device as claimed in claim 11, wherein said plurality of struts includes third struts provided on said back plate extending parallel to each other in a first direction and spaced a predetermined pitch, and fourth struts provided on said beam control layer extending parallel to each other in a second direction, perpendicular to said first direction, and spaced a predetermined pitch, so that said struts are held in contact crossingly with each other at their tips.

13. A flat panel display device as claimed in claim 12, wherein said struts are separated.

14. A flat panel display device comprising:

a face plate made of transparent material;

a back plate positioned parallel to said face plate;

a wall member extending between said face plate and back plate around the perimeter thereof to define an airtight housing:

first and second beam control layers placed one over the other and inserted between said face plate and back plate;

an anode provided on an inner surface of said face plate;

a fluorescent layer provided in association with said anode;

a cathode provided in association with said back plate; and a plurality of struts made of electrically conductive material tightly held between said first and second beam control layers, whereby an electric charge accumulated between said first and second beam control layers is discharged by a leakage current flowing through said struts, wherein said struts includes first struts provided on said first beam control layer extending parallel to each other in a first direction and spaced a predetermined pitch, and second struts provided on said second beam control layer extending parallel to each other in a second direction, perpendicular to said first direction, and spaced a predetermined pitch, so that struts are held in contact crossingly with each other at their tips.

15. A flat panel display device as claimed in claim 14, wherein said struts are separated.

* * * * *